US009731510B2

(12) United States Patent
Yamamoto et al.

(10) Patent No.: US 9,731,510 B2
(45) Date of Patent: Aug. 15, 2017

(54) INKJET PRINTING APPARATUS

(75) Inventors: Takaharu Yamamoto, Kyoto (JP); Hiroyuki Fuchioka, Kyoto (JP)

(73) Assignee: Screen Holdings Co., Ltd., Kyoto (JP)

( * ) Notice: Subject to any disclaimer, the term of this patent is extended or adjusted under 35 U.S.C. 154(b) by 0 days.

(21) Appl. No.: 14/003,221

(22) PCT Filed: Sep. 22, 2011

(86) PCT No.: PCT/JP2011/005351

§ 371 (c)(1),
(2), (4) Date: Sep. 4, 2013

(87) PCT Pub. No.: WO2012/127543

PCT Pub. Date: Sep. 27, 2012

(65) Prior Publication Data

US 2014/0002541 A1 Jan. 2, 2014

(30) Foreign Application Priority Data

Mar. 24, 2011 (JP) ..... 2011-065633

(51) Int. Cl.
*B41J 2/165* (2006.01)
*B41J 25/00* (2006.01)

(52) U.S. Cl.
CPC ..... *B41J 2/16505* (2013.01); *B41J 2/16523* (2013.01); *B41J 2/16532* (2013.01); *B41J 2/16585* (2013.01); *B41J 2025/008* (2013.01)

(58) Field of Classification Search
None
See application file for complete search history.

(56) References Cited

U.S. PATENT DOCUMENTS

2006/0268051 A1 11/2006 Umeda et al.
2007/0085874 A1 4/2007 Shindo
2009/0015625 A1 1/2009 Sumida
2011/0242203 A1* 10/2011 Yamamoto ..... B41J 2/16523 347/29

FOREIGN PATENT DOCUMENTS

JP 2008-213216 9/2008
JP 2010-125746 6/2010

OTHER PUBLICATIONS

International Search Report for PCT Application No. PCT/JP2011/005351 dated Oct. 18, 2011, 1 page.

* cited by examiner

*Primary Examiner* — Alejandro Valencia
(74) *Attorney, Agent, or Firm* — Dorsey & Whitney LLP

(57) ABSTRACT

Disclosed is an inkjet printing apparatus including a connection switching device in a housing having external suction ports and an internal suction port being disposed at an equal distance from the center of rotation of a switching section, the external suction ports being connectable to a plurality of lines, the internal suction port being connected to a suction path for sucking the interior of the housing. The connection switching device selectively connects any of the plurality of external suction ports to the suction device by rotating the switching section Consequently, when the switching section is connected to the internal suction port, the interior of the housing is sucked, whereby ink is sucked from all the inkjet nozzles.

10 Claims, 8 Drawing Sheets

INKJET PRINTING APPARATUS

BACKGROUND

1. Field of the Invention

This invention relates to an inkjet printing apparatus with a plurality of inkjet heads.

2. Description of the Related Art

A conventional inkjet printing apparatus having an inkjet head with many inkjet nozzles performs cleaning to the inkjet head by suction (suction purge) so as to eliminate printing failure, so-called nozzle clogging, resulting from partial clogging of the inkjet nozzles.

For instance, Japanese Patent Publication No. 2008-213216 discloses an inkjet recorder. The inkjet recorder includes caps covering ejection port groups (an inkjet head) individually, and a pump supplying ink from the ejection ports (inkjet nozzles) into the caps. The inkjet recorder further includes a connection channel connecting the caps to the pumps, respectively, and on/off valves provided on the channel individually. In the inkjet recorder, the on/off valves on the connection channel in communication with each of the caps of the group of ejection ports (inkjet heads) are selectively opened, whereby suction purge can be achieved in which only a cap covering the inkjet nozzle with no ink being ejected therefrom is connected to the pump to be sucked individually.

Another inkjet printing apparatus has also been proposed. The inkjet printing apparatus includes a cleaning mechanism that allows overall suction for sucking collectively a plurality of inkjet heads and individual suction for sucking every inkjet head individually. See International Publication WO2007/058139. The cleaning mechanism includes an individual suction cap that connects one cap, selected from caps covering a plurality of inkjet heads, to a pump via a tube; the caps connected to the pump via a tube branched to the caps; a first on/off valve switching suction of the plurality of caps simultaneously; and a second on/off valve switching suction of only the individual suction cap. Overall suction is performed while the plurality of inkjet heads are all covered with the caps to open the first and second on/off valves. Individual suction is performed while only one inkjet head is covered with the individual suction cap to close the first on/off valve and to open the second on/off valve. This allows individual suction for the inkjet head to be sucked.

The apparatus disclosed in Japanese Patent Publication No. 2008-213216 has a drawback as under. That is, many electromagnetic on/off valves corresponding to the number of caps have to be disposed, resulting in an enlarged apparatus and increased production costs. The apparatus has another drawback as under. That is, many electromagnetic on/off valves are driven, resulting in increased power consumption and running costs.

Moreover, the apparatus of WO2007/058139 performs cleaning to every inkjet unit having a plurality of inkjet heads being arranged in one direction. Consequently, when individual suction is performed to the inkjet heads, it takes longer time to move the inkjet unit to align the inkjet heads with the individual suction cap depending on arrangement of the inkjet heads to be sucked in the inkjet unit. This causes a drawback that longer time is required for cleaning the inkjet heads.

In order to solve the above-mentioned drawbacks, one object of this invention is to provide an inkjet printing apparatus with a simple construction that allows reduction in ink consumption and rapid cleaning of inkjet heads.

SUMMARY

This invention is constituted as stated below to achieve the above object. One example of this invention discloses an inkjet printing apparatus with a plurality of inkjet heads having a plurality of inkjet nozzles being arranged in a row; a plurality of caps for the plurality of inkjet heads respectively; a plurality of lines in communication with the plurality of caps respectively; and a suction device sucking ink from the plurality of inkjet nozzles via the plurality of caps and the plurality of lines. The inkjet printing apparatus includes a draw-off port connecting to the suction device; a switching section having an internal communication path in communication with the draw-off port and being supported rotatably while being connected to a driving device; a housing accommodating the switching section and having external suction ports and an internal suction port being disposed at an equal distance from the center of rotation of the switching section, the external suction ports being connectable to the plurality of lines, the internal suction port being connected to a suction path for sucking an interior of the housing; further including a connection switching device for selectively connecting the suction port to the suction device by rotating the switching section to a position where the communication path is brought into communication with any of the plurality of external suction ports.

The example of this invention includes the connection switching device for selectively connecting any of the plurality of external suction ports to the suction device by rotating the switching section in the housing having the external suction ports and the internal suction port being disposed at an equal distance from the center of rotation of the switching section. Here, the external suction ports are connectable to the plurality of lines, and the internal suction port is connected the suction path for sucking the interior of the housing. When the switching section is connected to any of the external suction ports, ink is sucked from any of the plurality of inkjet nozzles. When the switching section is connected to the internal suction port, the interior of the housing is sucked, whereby ink is sucked from all the inkjet nozzles. Consequently, reduction in ink consumption due to suction purge of the inkjet head in no need of suction purge can be achieved. Moreover, rapid cleaning can be performed to the plurality of inkjet heads selectively.

In addition, the housing in the example of this invention preferably includes the draw-off port of the suction path on the bottom of the housing, the suction path sucking the interior of the housing.

In addition, the housing in the example of this invention preferably includes the plurality of external suction ports arranged radially.

In addition, the housing in the example of this invention preferably includes the plurality of external suction ports arranged coaxially.

In addition, the housing in the example of this invention preferably includes the suction path sucking the interior of the housing.

In addition, the switching section in the example of this invention has an L-shape. A first end of the switching section rotates by the driving device, whereas a second end thereof is communicated with each of the plurality of external suction ports. Such a construction is preferable.

In addition, the switching section in the example of this invention has a crank shape. A first end of the switching section rotates by the driving device, whereas a second end thereof is communicated with each of the plurality of external suction ports. Such a construction is preferable.

In addition, the housing in the example of this invention preferably includes a closed bearing at the center of rotation of the switching section.

In addition, the plurality of inkjet heads is provided for every single-color ink.

The inkjet printing apparatus in the example of this invention includes the connection switching device for selectively connecting any of the plurality of external suction ports to the suction device by rotating the switching section in the housing having the external suction ports and the internal suction port being disposed at an equal distance from the center of rotation of the switching section. Here, the external suction ports are connectable to the plurality of lines, and the internal suction port connects the suction path for sucking the interior of the housing. When the switching section is connected to any of the external suction ports, ink is sucked from any of the plurality of inkjet nozzles. When the switching section is connected to the internal suction port, the interior of the housing is sucked, whereby ink is sucked from all the inkjet nozzles. Consequently, reduction in ink consumption due to suction purge of the inkjet head in no need of suction purge can be achieved. Moreover, rapid cleaning can be performed to the plurality of inkjet heads selectively.

Moreover, the housing includes inside thereof the draw-off port of the suction path sucking the interior of the housing. This ensures suction of ink accumulated in the interior of the housing.

Moreover, the housing has the suction path formed therein for sucking the interior of the housing. This achieves a compact housing.

DETAILED DESCRIPTION

Description will be given hereinafter of examples of this invention with reference to the drawings.

Example 1

Figure 1:
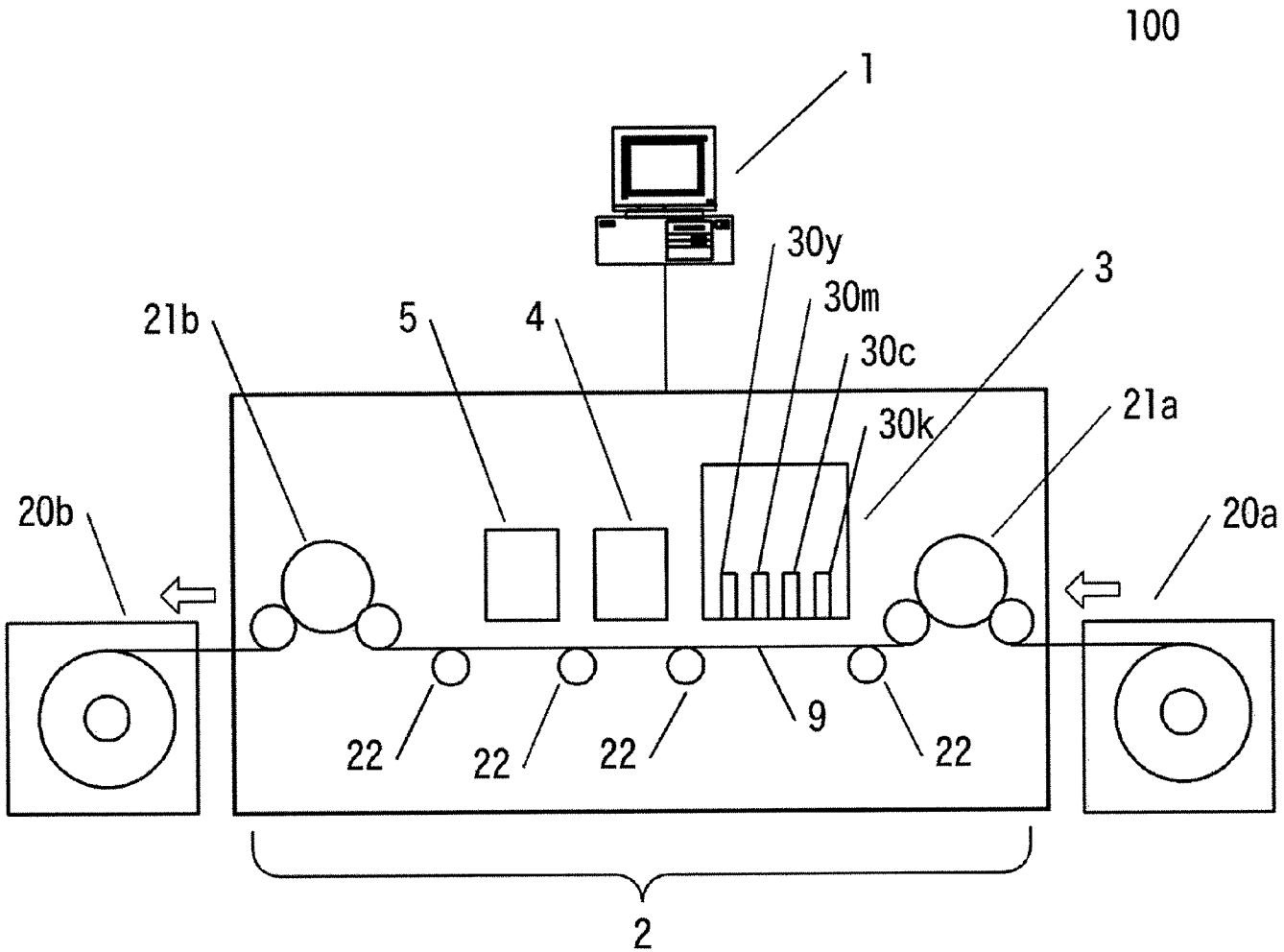
FIG. 1 is an explanatory view of an inkjet printing apparatus 100.

FIG. 1 illustrates an inkjet printing apparatus 100 according to one example of this invention. The inkjet printing apparatus 100 performs printing by ejecting ink onto a roll sheet to be transported. The inkjet printing apparatus 100 includes a controller 1, a transporting section 2, an ejector 3, a drying section 4, and an inspecting section 5.

The controller 1 controls the inkjet printing apparatus 1 entirely. The controller 1 controls transportation of a sheet 9 by the transporting section 2, ejection of ink onto the sheet 9 by the ejector 3 or cleaning in the ejector 3, drying of the sheet 9 with the ink ejected thereon by the drying section 4, imaging of a printing image on the sheet 9 by the inspecting section 5. Such control achieves printing onto the sheet 9 by the inkjet printing apparatus 100.

The transporting section 2 transports the sheet 9 in the inkjet printing apparatus 100. The transporting section 2 includes a sheet accommodating section 20, a drive roller 21, and a support roller 22.

The sheet accommodating section 20 accommodates the sheet 9 as a roll sheet to be printed. A sheet accommodating section 20*a* accommodates the printing sheet 9 prior to printing, and a sheet accommodating section 20*b* accommodates the sheet 9 subsequent to the printing.

The sheet 9 fed out from the sheet accommodating section 20*a* is transported to the ejector 3, the drying section 4, and the inspecting section 5 with drive rollers 21*a* and 21*b* while being supported by the support roller 22. Then the sheet 9 is wound up in the sheet accommodating section 20*b*.

The ejector 3 receives ink from an ink tank, not shown. The ejector 3 ejects the ink in response to drive signals generated by the controller 1 in accordance with image information, thereby performing printing onto the sheet 9.

The ejector 3 includes a plurality of inkjet nozzle groups 30*k*, 30*c*, 30*m*, and 30*y*. The inkjet nozzle groups 30*k*, 30*c*, 30*m*, and 30*y* extend perpendicularly relative to a transport direction of the sheet 9. Arrangement of many nozzles in a row achieves a width of ejection more than a width of the sheet 9 to be transported. Such a construction of the ejector 3 achieves printing by one-time ejection without performing reciprocated scanning in a width direction of the sheet 9 to be transported.

Here, the number of inkjet nozzle groups in the ejector 3 is limited to four, but may be one for single-color ejection. Moreover, the number of inkjet nozzle groups may be five or more for additional special-color ejection.

The drying section 4 heats the sheet 9 subsequent to printing by the ejector 3 with use of a heater, a dryer, and the like, to evaporate solvent of ink (mainly, water). Consequently, the ink is fixed.

The drying section 4 includes a construction of oscillating radiation. Consequently, when radiation-curable ink, such as an ultraviolet-curable ink, is ejected from the ejector 3, the ink is fixed (cured) on the sheet 9.

The inspecting section 5 takes printing images so as to determine whether or not the controller 1 performs printing onto the sheet 9 satisfactorily. The inspecting section 5 takes a printing image 5 printed on the sheet 9 to be transported with use of a CCD line sensor or a CCD camera, and then transmits information on the image to the controller 1. The controller 1 compares the image information used for ink ejection with photographic information to determine an ejection failure in the ejector 3. This enables to determine whether or not the printing is performed satisfactorily.

Here, the ejection failure is, for example, no-ink ejection from the nozzle, failure in spraying of ink droplets, or failure in size of ink droplets. When the controller 1 determines such an ejection failure in the ejector 3, the controller 1 performs cleaning of the ejector 3.

Figure 2:
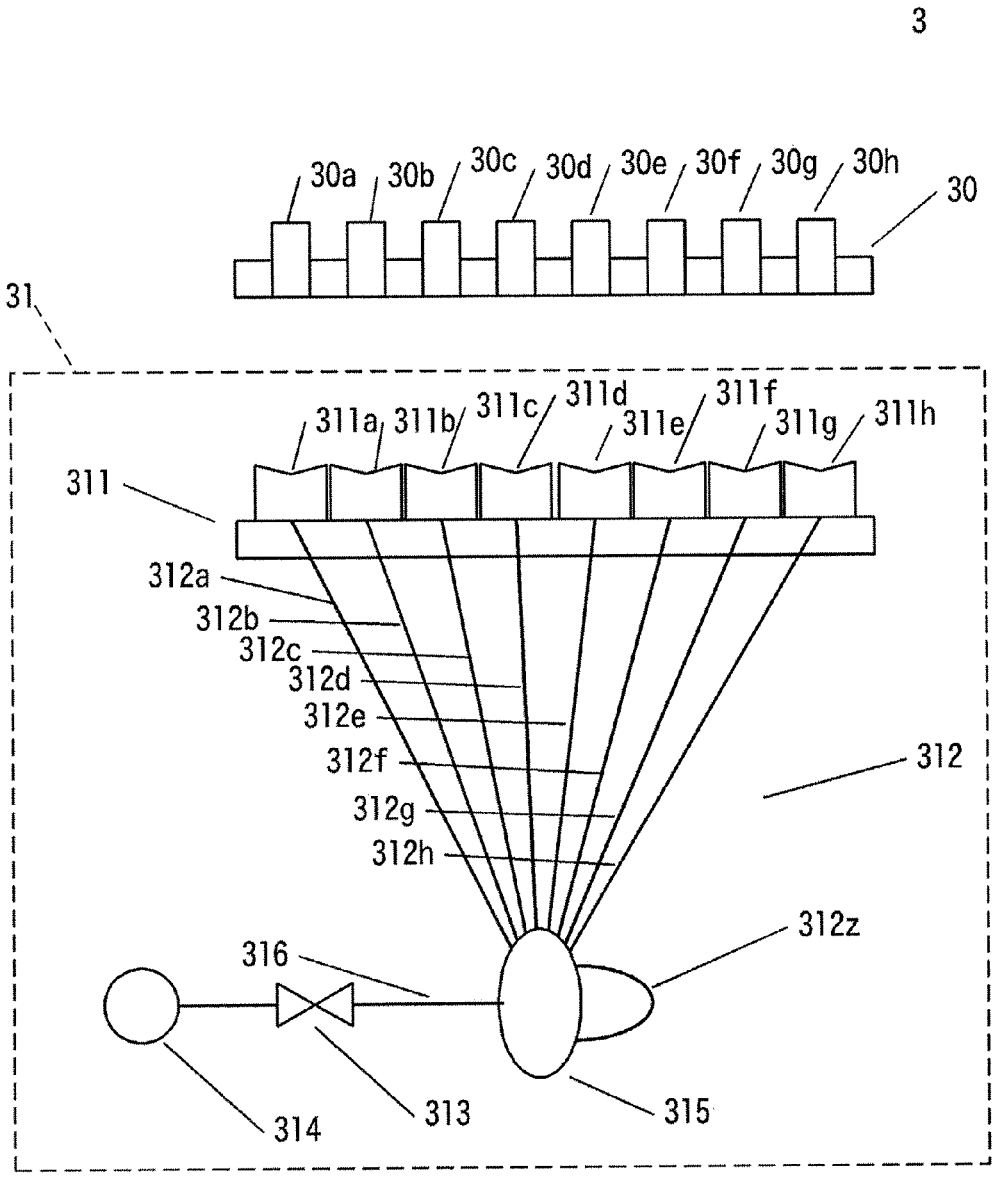
FIGS. 2 and 3 are explanatory views each illustrating an ejector 3.
Figure 3:
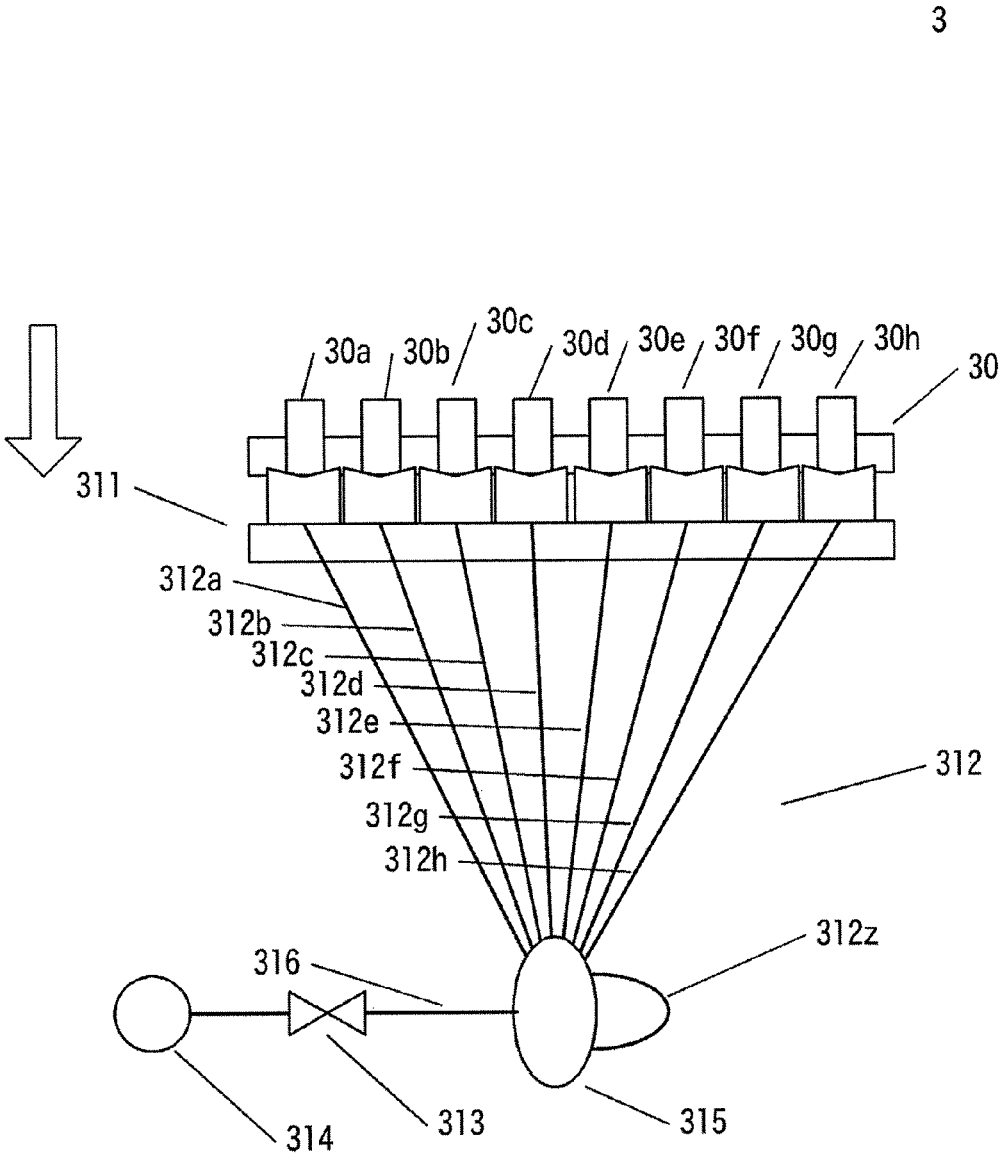

FIGS. 2 and 3 are schematic views of the ejector 3 to which cleaning is performed. FIG. 2 illustrates the ejector 3 performing printing onto the sheet 9, whereas FIG. 3 illustrates the ejector 3 to which the cleaning is performed.

The ejector 3 includes a cleaning section 31 for cleaning an inkjet nozzle group. The cleaning section 31 has a suction cap 311, a suction tube 312, an electromagnetic on/off valve 313, a suction pump 314, a connection switching section 315, and a suction line 316.

Here, description will be given assuming that eight inkjet heads 30*a* to 30*h* are arranged in a row to form one inkjet nozzle group 30. Of course, the number of inkjet heads arranged in a row to form the inkjet nozzle group 30 of is limited to eight.

Moreover, for explanation purposes, the ejector 3 includes one cleaning section 31 for one inkjet nozzle group 30. In actual, the ejector 3 includes a plurality of cleaning sections 31 for a plurality of inkjet nozzle groups 30, respectively.

The suction cap 311 covers the inkjet nozzle group 30 so as to prevent the nozzles from being dried or contaminated. The suction cap 311 includes the suction tube 312 connected to the suction pump 314. The suction cap 311 performs covering as illustrated in FIG. 3 while the controller 1 controls the inkjet nozzle group 30 to move downward. This allows suction for eliminating ink clogging in the inkjet nozzle group 30.

Here, suction caps 311*a* to 311*h* are provided for inkjet heads 30*a* to 30*h*, respectively.

The suction tube 312 is connected to the suction cap 311 as noted above. The suction pump 314 sucks ink via the suction tube 312 from the inkjet nozzle group 30 covered with the suction cap 311.

Here, suction tubes 312*a* to 312*h* are provided for the suction caps 311*a* to 311*h*, respectively, and are connected to the connection switching section 315 so as to allow suction.

In addition, a suction tube 312*z* is not connected to the suction cap 311 directly, but is connected to the switching section 315 so as to suck the interior of the connection switching section 315.

This achieves suction of ink from the suction caps 311*a* to 311*h*. Details thereof are to be mentioned later.

The electromagnetic on/off valve 313 is disposed on the suction line 316 via which the suction pump 314 and the connection switching section 315 are connected. As illustrated in FIG. 2, the controller 1 controls the electromagnetic on/off valve 313 to close the suction line 316 while the inkjet nozzle group 30 performs ejection to the sheet 9. As illustrated in FIG. 3, when the ink is sucked from the inkjet heads 30*a* to 30*h* while the suction cap 311 covers the inkjet nozzle group 30 and the connection switching section 315 switchingly connects the suction pump 314 to the suction tubes 312*a* to 312*h*, the controller 1 controls the electromagnetic on/off valve 313 to open the suction line 316. Details thereof are to be mentioned later.

In addition, when the suction pump 314 collectively sucks ink from the inkjet heads 30*a* to 30*h* while the switching section 315 switchingly connects the suction tube 312*z*, the controller 1 controls the electromagnetic on/off valve 313 to open the suction line 316. Details thereof are to be mentioned later.

The suction pump 314 sucks the ink from the inkjet nozzle group 30 through the suction line 316, the connection switching section 315, the suction tube 312*a* to 312*h* or 312*z*, and the suction cap 311 under the state as in FIG. 3. When the suction pump 314 generates negative pressure, ink is discharged from the inkjet nozzle group 30. The ink discharged due to negative pressure is accumulated in a drain tank, not shown, of the inkjet printing apparatus 100 through the suction cap 311, the suction tube 312, the connection switching section 315, the suction line 316, and the suction pump 314.

When the suction pump 314 sucks the ink in the inkjet nozzle group 30, the controller 1 controls the connection switching section 315 to switch the suction line 316 and the suction tube 312*a* to 312*h* or 312*z* so as to individually suck the inkjet heads 30*a* to 30*h* forming the inkjet nozzle group 30 or collectively suck the inkjet heads 30*a* to 30*h*.

The connection switching section 315 is to be described in detail hereinafter with reference to FIGS. 4 and 5.

Figure 4:
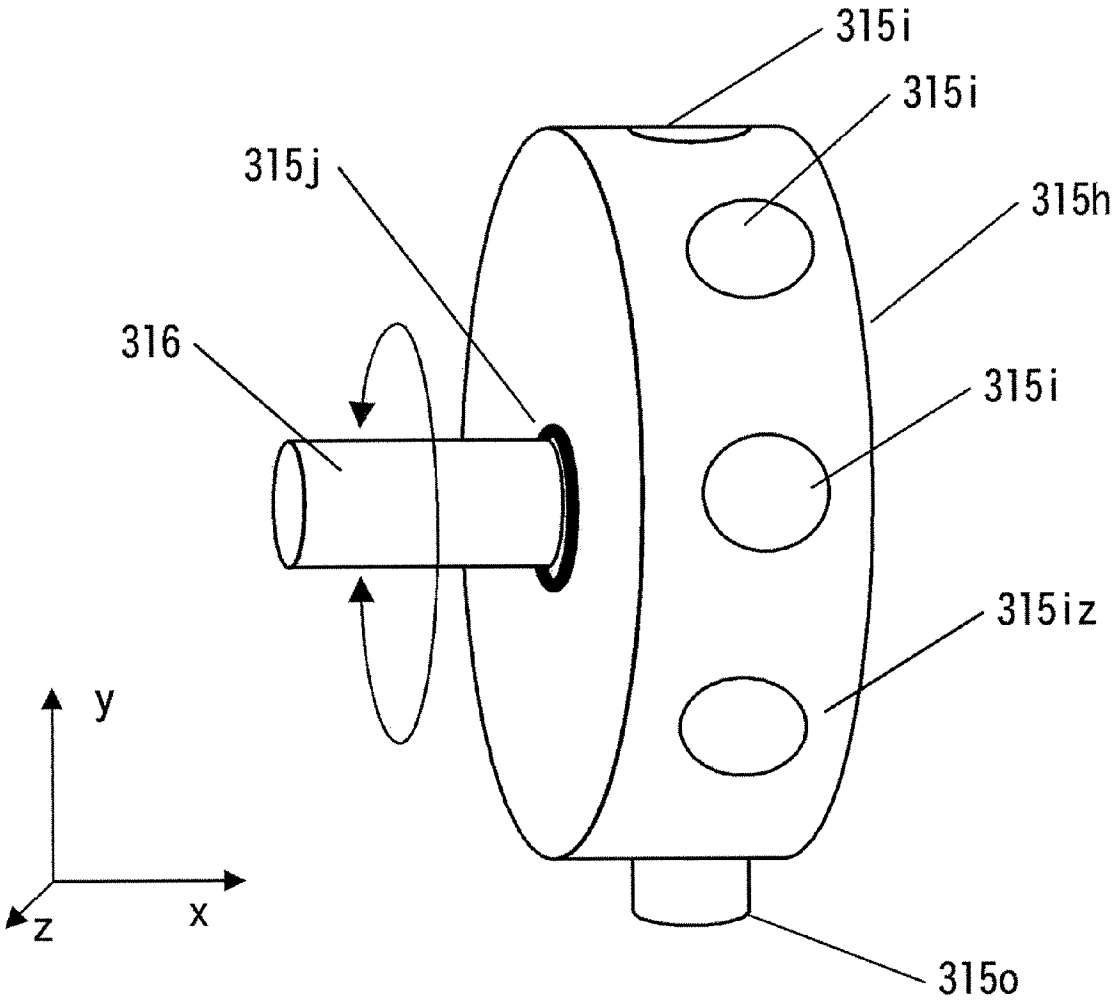
FIGS. 4 and 5 are explanatory views each illustrating an external structure of a connection switching section 315.

FIG. 4 illustrates an external construction of the connection switching section 315. The switching section 315 includes a housing 315 for sealingly accommodating therein a switching section 315*k* (not shown in this drawing) communicated with the suction line 316. The housing 315*h* includes a plurality of suction ports 315*i* for connecting the suction tubes 312*a* to 312*h*, and 312*z*.

The housing 315*h* includes a sealed bearing 315*j* that enables to rotate the switching section 315*k*. The bearing 315*j* allows rotating the switching section 315*k* by a motor, not shown, while the interior of the housing 315*h* is kept sealed.

The plurality of suction ports 315*i* are disposed radially along the outer periphery of the housing 315*h* so as to correspond to the suction tubes 312*a* to 312*h*, and 312*z*.

Specifically, a suction port 315*ia* is connected to be in communication with the suction tube 312*a*. A suction port 315*ib* is connected to be in communication with the suction tube 312*b*. Hereinafter, similar connection is performed, and the suction port 315*ih* is similarly connected to be in communication with the suction tube 312*h*.

Moreover, the suction port 315*iz* is connected to be in communication with the suction tube 312*z*. Here, the suction tube 312*z* is connected to be in communication not with the inkjet nozzle group 30 but with an ink draw-off port 315*o* provided on the housing 315*h*.

The ink draw-off port 315*o* draws off the ink accumulated in the housing 315*h* when the inkjet nozzle group 30 is entirely sucked, which is to be mentioned later. The ink draw-off port 315*o* is preferably disposed on the bottom of the housing 315*h* for a suitable position of drawing off the accumulated ink, the position being in a negative (−) Y-axis direction when the direction is represented by X-, Y-, and Z-axes.

The housing 315*h* can be made from stainless steel, titanium, or fluorocarbon resin, the material having resistance to pressure upon suction by the suction pump 314 and resistance to corrosion from ink.

Figure 5:
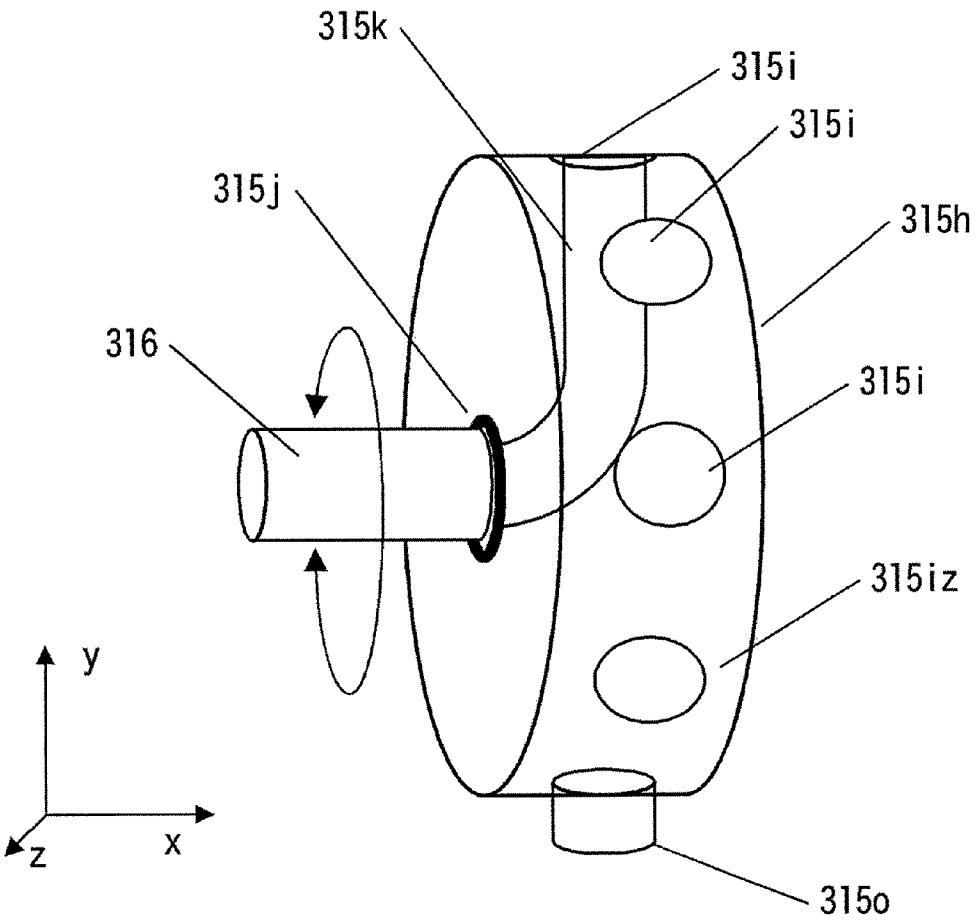

FIG. 5 is an explanatory view of an internal construction of the connection switching section 315. The connection switching section 315 includes inside thereof a rotatable switching section 315*k* communicated with the suction line 316.

The switching section 315*k* has a substantially L-shape. The controller 1 controls the switching section 315*k* to rotate by the motor, not shown, whereby the switching section 315*k* is slidingly engaged in each of the plurality of suction ports 315*i*. When the switching section 315*k* is engaged in the suction port 315*i*, the suction tube 312 is brought into communication with the suction line 316. Consequently, the suction pump 314 enables to suck the ink from the inkjet nozzle group 30 covered with the suction cap 311.

The site where the switching section 315*k* is engaged in the suction port 315*i* preferably has a sealing construction, such as a grease seal, a rubber seal, or a metal seal, for obtaining efficient suction or entire suction of the inkjet nozzle group 30, to be mentioned later.

The plurality of suction ports 315*ia* to 315*ih* is connected to be in communication with the suction tubes 312*a* to 312*h*, respectively. The suction tube 312*z* connected to the suction port 315*iz* is connected to be in communication with the ink draw-off port 315*o* provided on the bottom of the housing 315*h* as illustrated. Such connection causes the switching section 315*k* to be slidingly engaged in the suction port 315*iz*, thereby bringing the suction tube 312*z* to be in communication with the suction line 316. Consequently, the suction pump 314 enables to suck the interior of the housing 315*h*.

Figure 6A:
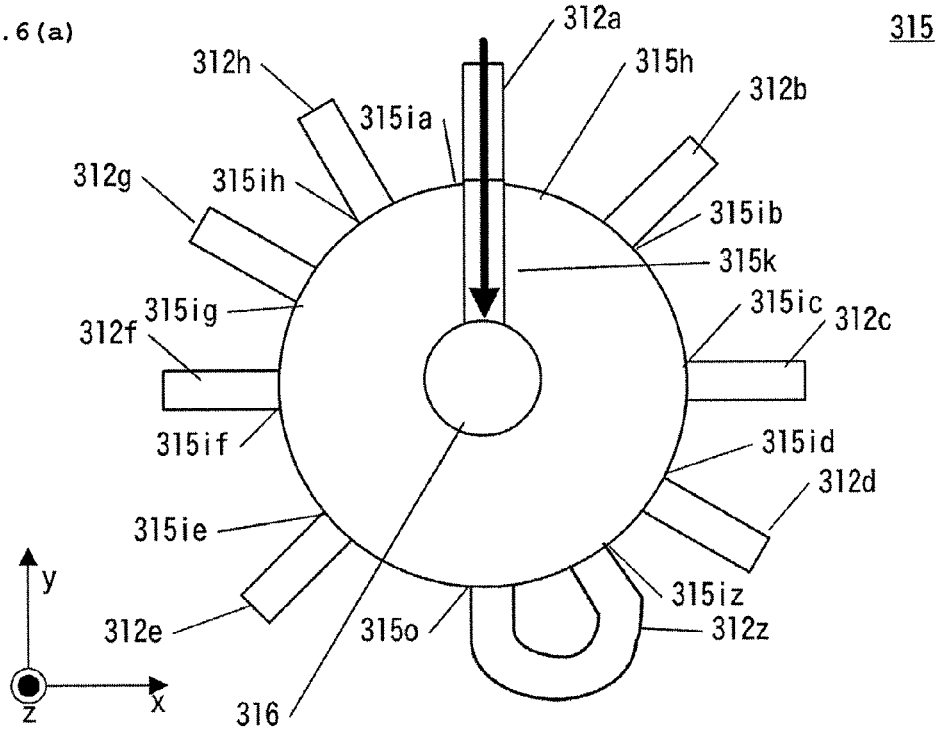
FIG. 6 is an explanatory view for suction of a group of inkjet nozzles by an operation of the connection switching section 315.
Figure 6B:
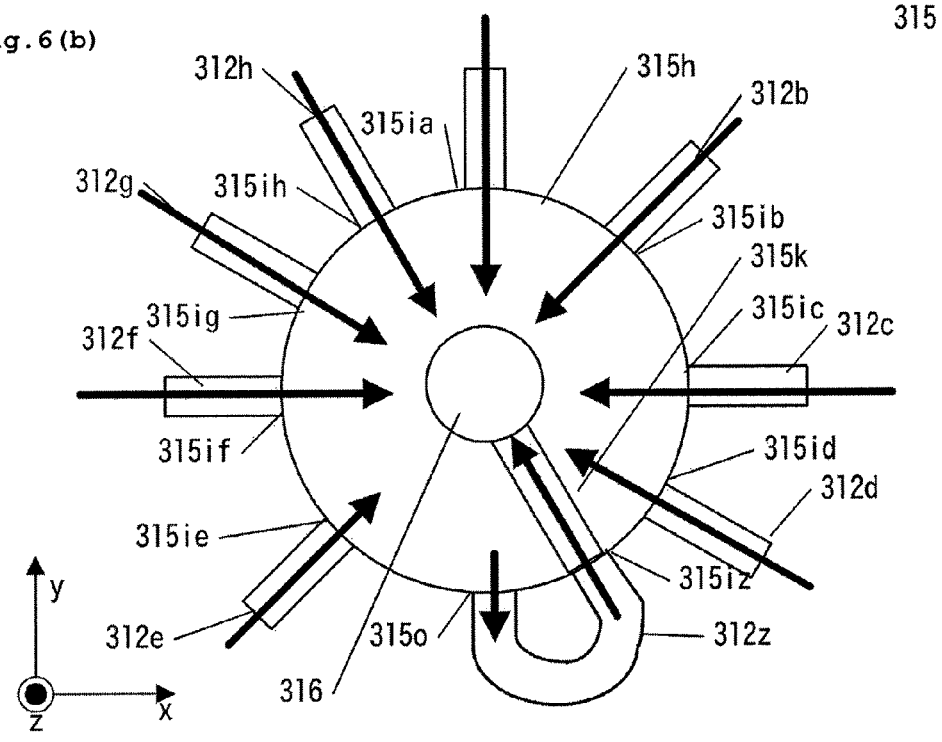

FIG. 6 is an explanatory view of suction of the inkjet nozzle group 30 by the connection switching section 315.

FIG. 6(*a*) illustrates an interior housing 315*h* for explanation of sucking the inkjet heads 30*a* to 30*h* individually when the cleaning section 31 performs cleaning to the inkjet nozzle group 30. Here, the switching section 315 performs operations for sucking the ink in the inkjet head 30*a*.

The controller 1 controls the switching section 315*k* to rotate and be slidingly engaged in the suction port 315*ia* while the ejector 3 is in the state as illustrated in FIG. 3. Accordingly, the suction tube 312*a* is brought into communication with the suction line 316. Thereafter, the electromagnetic on/off valve 313 is made "open" so as the suction pump 314 to start suction, whereby a sliding engaged portion is sealed and the suction line 316 has negative pressure. The negative pressure causes the ink to be discharged from the inkjet head 30*a* covered with the suction cap 311*a* via the suction tube 312*a* communicated with the suction line 316. The discharged ink is sucked by the suction pump 314 through the suction cap 311*a* and the suction tube 312*a* to be accumulated in the drain tank, not shown, of the inkjet printing apparatus 100.

When the ink is sucked from each of the inkjet heads 30*b* to 30*h*, the controller 1 controls the switching section 315*k* to rotate and be slidingly engaged in each of the suction ports 315*ib* to 315*ih*, thereby opening the electromagnetic on/off valve 313 and performing suction by the suction pump 314. Consequently, similar to the inkjet head 30*a*, the ink can be sucked from each of the inkjet heads 30*b* to 30*h*.

FIG. 6(*a*) illustrates ink suction. The suction is preferable for cleaning the inkjet nozzle group 30 by the cleaning section 31, especially for cleaning each of the inkjet heads 30*a* to 30*h* in a defective condition.

On the other hand, many number of inkjet heads forming the inkjet nozzle group 30 requires much time to repeatedly perform the operation as in FIG. 6(*a*) for sucking the ink from all of the inkjet heads. This is because the ink has to be sucked from every inkjet head.

For instance, when ink is sucked in a manner as illustrated in FIG. 6(*a*), it needs time until pressure within the suction cap 311 returns into atmospheric pressure in order to eliminate redundant ink ejection due to the negative pressure. Assuming that the time is around ten seconds for one inkjet head and the number of inkjet heads is eight, idling time of eighty seconds occurs during a cleaning process.

In order to solve the problem above, the housing 315*h* of the cleaning section 31 includes the ink draw-off port 315*o* for sucking the interior of the housing 315*h*.

FIG. 6(*b*) illustrates an interior housing 315*h* for explanation of sucking the inkjet heads 30*a* to 30*h* collectively when the cleaning section 31 performs cleaning to the inkjet nozzle group 30. Here, the switching section 315 performs operations for sucking the ink entirely from the inkjet nozzle group 30.

The controller 1 controls the switching section 315*k* to rotate and be slidingly engaged in the suction port 315*iz* while the ejector 3 is in the state as illustrated in FIG. 3. Accordingly, the suction tube 312*z* is brought into communication with the suction line 316, the suction tube 312*z* being connected to be in communication with the ink draw-off port 315*o*. Thereafter, the electromagnetic on/off valve 313 is made "open" so as the suction pump 314 to start suction, whereby a sliding engaged site is sealed and the suction line 316 has negative pressure. Accordingly, the interior of the housing 315*h* where the ink draw-off port 315*o* passes also has negative pressure.

Here, the housing 315*h* has a sealed construction. Consequently, negative pressure within the housing 315*h* is also applied to the suction caps 311*a* to 311*h* via the suction tubes 312*a* to 312*h* connected to the suction ports 315*ia*, respectively. This causes the ink to be discharged from the inkjet heads 30*a* to 30*h*.

The ink discharged from the inkjet heads 30*a* to 30*h* flows into the housing 315*h* via the suction caps 311*a* to 311*h*, the suction tubes 312*a* to 312*h*, and the suction ports 315*ia* to 315*ih*.

The ink flown into the housing 315*h* is discharged through the ink draw-off port 315*o* into the suction port 315*iz*. Here, the ink draw-off port 315*o* disposed on the bottom of the housing 315*h* collects the ink accumulated within the housing 315*h* naturally, resulting in efficient ink suction.

Thereafter, the ink is sucked by the suction pump 314 from the ink draw-off port 315*o* through the suction tube 312*z* and then through the switching section 315*k* slidingly engaged in the suction port 315*iz*. Accordingly, the ink is accumulated in the drain tank, not shown, of the inkjet printing apparatus 100.

As noted above, ink suction illustrated in FIG. 6(*b*) causes all the inkjet heads 30*a* to 30*h* to be cleaned for a short period of time when the cleaning section 31 performs cleaning to the inkjet nozzle group 30.

As noted above, the cleaning section 31 in FIG. 2 of the inkjet printing apparatus. 100 in FIG. 1 includes the connection switching section 315 in FIGS. 4 and 5. Consequently, when the switching section 315*k* is connected to any of the suction ports 315*ia* to 315*ih*, the ink is sucked from any of the inkjet heads 30*a* to 30*h*. When the switching section 315*k* is connected to the suction port 315*iz*, the interior of the housing 315*h* is sucked via the ink draw-off port 315*o*, whereby the ink is sucked from the entire inkjet nozzle group 30. As a result, reduction in ink consumption due to the suction purge of the inkjet head in no need of suction purge can be achieved. Moreover, rapid cleaning can be performed selectively to the plurality of inkjet heads.

Moreover, ink accumulated in the suction caps 311*a* to 311 is sucked as in FIG. 6(*b*) not only by ink suction from the inkjet nozzle group 30 but also by flushing or pressure purge performed to the inkjet nozzle group 30 by the controller 1. Consequently, the ink can be prevented from flowing out of the suction cap 311.

Example 2

Description has been given of the housing 315*h* of the connection switching section 315, the housing being substantially cylindrical and having a plurality of suction ports 315*i* along the outer periphery thereof. The location of the plurality of suction ports 315*i* in the housing 315*h* is not limited to this.

Figure 7A:
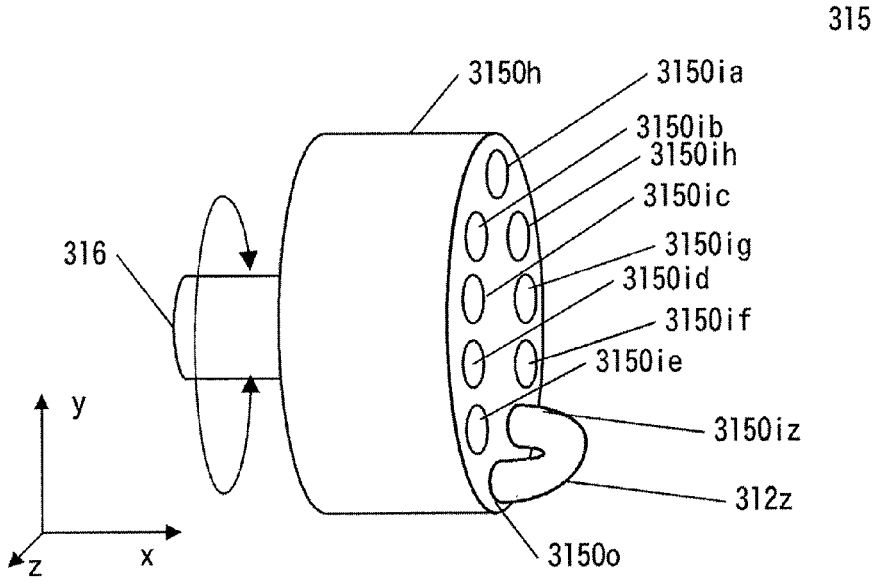
FIG. 7 is an explanatory view of another aspect of the connection switching section 315.
Figure 7B:
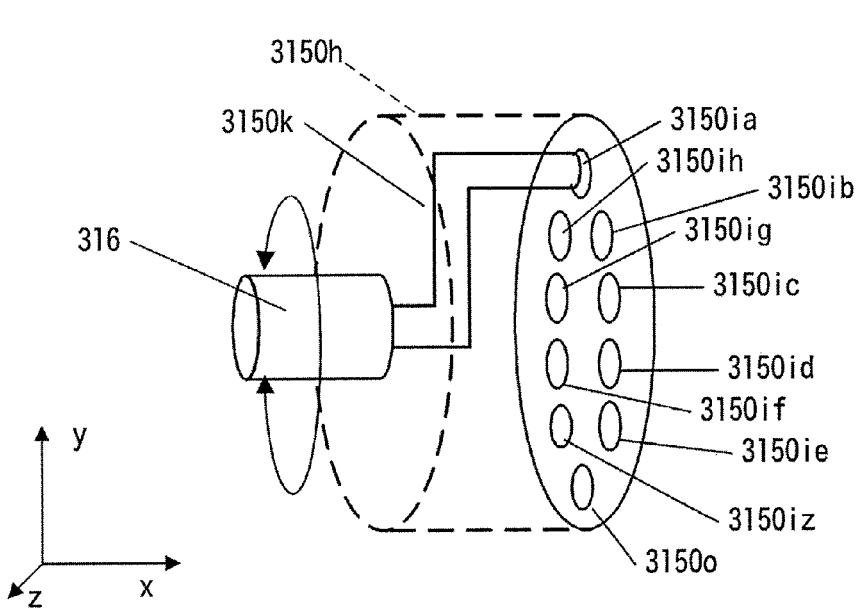

FIG. 7 is an explanatory view of another aspect of the connection switching section 315.

In a housing 3150*h* of the connection switching section 315 illustrated in FIG. 7(*a*), a plurality of suction ports 3150*i* is not arranged along the outer periphery of the housing 3150*h* but is arranged coaxially and parallel to the center axis of the housing 3150*h* having a substantially cylindrical shape. The plurality of suction ports 3150*i* is arranged in a direction opposite to the suction line 316. In this case, an ink ejection port 3150*o* also enables to be disposed on the bottom of the housing 3150*h*.

FIG. 7(*b*) illustrates the connection switching section 315 seen from the suction line 316. Here, a disk and an outer peripheral surface of the suction line 316 in a suction side of the housing 3150*h* are illustrated by dotted lines for explanation purposes.

The switching section 3150*k* in FIG. 7(*b*) differs from that in FIG. 5 in shape. That is, the switching section 3150*k* has a substantially crank shape. The switching section 3150*k* is also in communication with the suction line 316. The controller 1 controls a motor, not shown, to rotate, thereby engaging the switching section 3150*k* in a plurality of suction ports 3150*i* formed in the housing 3150*h*.

The site where the switching section 3150*k* is slidingly engaged in the suction port 3150*i* preferably has a sealing construction, such as a grease seal, a rubber seal, or a metal seal, for obtaining efficient suction or entire suction of the inkjet nozzle group 30.

In the connection switching section 315 in FIG. 7, the suction line 316 and the plurality of suction ports 3150*i* are arranged substantially coaxially. This reduces a storage space in a Y-axis direction. In the inkjet printing apparatus 100, reduction in ink consumption due to the suction purge of the inkjet head in no need of suction purge can be achieved. Moreover, rapid cleaning can be performed selectively to the plurality of inkjet heads.

Example 3

Description has been given of the housing 315*h* or 3150*h* of the connection switching section 315 including ink draw-off port 315*o* or 3150*o* and suction port 315*iz* or 3150*iz* being connected to the suction tube 312*z* communicated with the ink draw-off port 315*o* or 3150*o*. Alternatively, the housing 315*h* or 3150*h* itself may include a suction path achieving the same function as the suction tube 312*z*.

Figure 8:
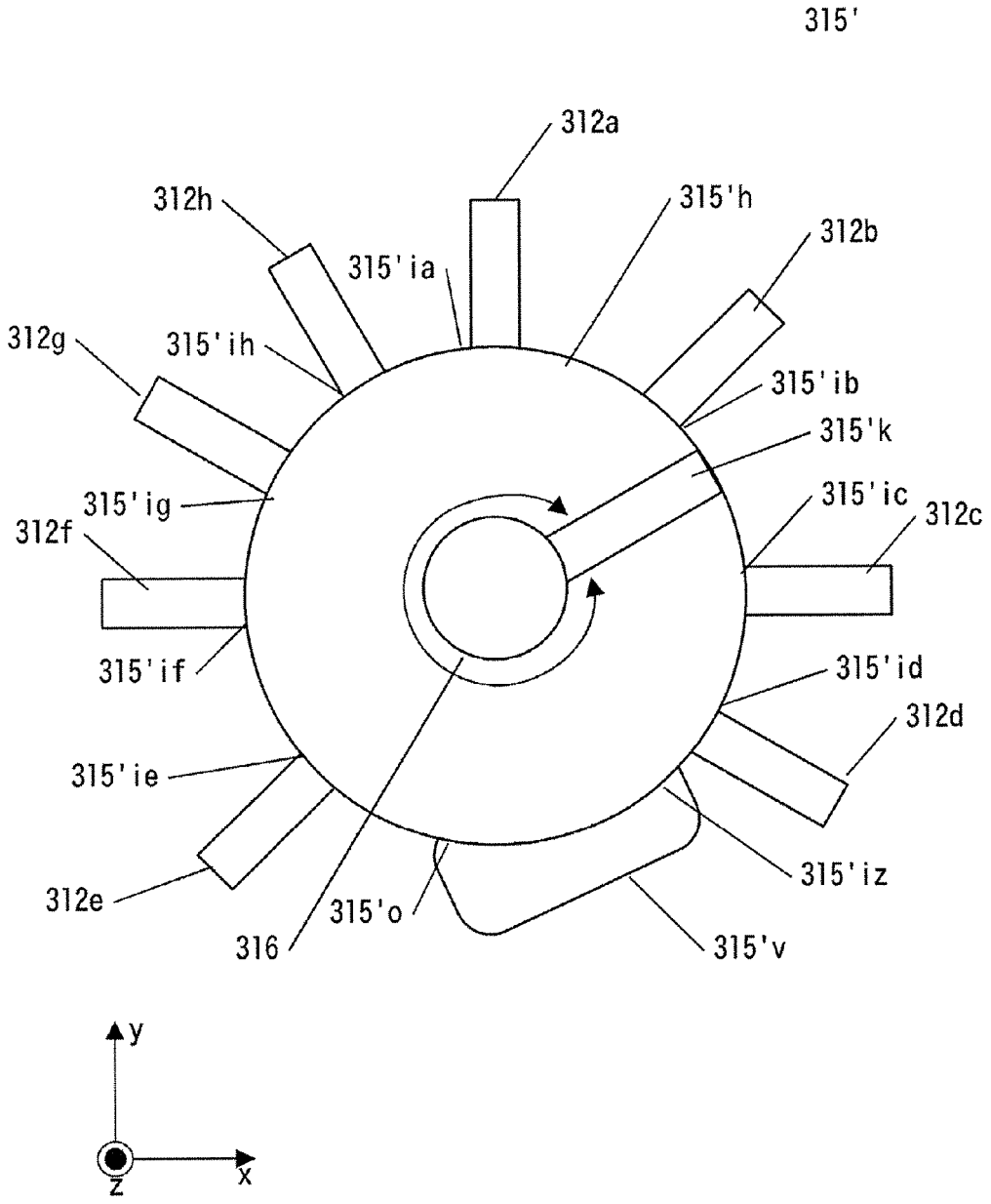
FIG. 8 is an explanatory view of a housing 315'*h* of the connection switching section 315.

FIG. 8 illustrates a housing 315'*k* of a connection switching section 315'. The housing 315'*h* includes a plurality of suction port 315'*i* formed by suction ports 315'*ia* to 315'*ih* on suction tubes 312*a* to 312*h*. Here, an ink draw-off port 315'*o* is communicated with the suction port 315'*iz* via a suction path 315'*v* formed on the housing 315'*h*.

In the inkjet printing apparatus 100, such a construction as above allows reduction in ink consumption due to the suction purge of the inkjet head having no need for suction purge can be achieved. Moreover, rapid cleaning can be performed selectively to the plurality of inkjet heads.

Modification

Description has been given of the housing 315*h* of the connection switching section 315 having a substantially cylindrical shape. Alternatively, the housing 315*h* may have a substantially cone, spherical zone, or spherical crown shape. Specifically, the housing 315*h* may have a shape with a plurality of suction ports 315*i* being arranged at an equal distance from the center of rotation of the switching section 315*k*. In this case, the similar effect as above can be produced.

In addition, description has been given of the connection switching section 315 disposed in the cleaning section 31 such that the switching section 315*k* has the center of rotation in a substantially horizontal direction. Alternatively, the connection switching section 315 may be disposed such that the switching section 315*k* has the center of rotation in a substantially vertical direction.

In this case, the ink draw-off port 315*o* on the bottom of the housing 315*h* causes the ink to be flown naturally and to be further accumulated. Consequently, the ink can be sucked efficiently from the entire inkjet nozzle group 30. Especially, the housing 315*h* having a substantially cone or spherical crown shape enables to increase efficiency.

Here, the solvent of ink to be cleaned by use in the inkjet printing apparatus 100 is not limited to water.

Moreover, the ink to be cleaned by use in the inkjet printing apparatus 100 may be not only dye ink used for general inkjet printing but also pigment ink.

Moreover, the ink to be cleaned by use in the inkjet printing apparatus 100 may be not only ink used for general printing but also functional ink used for circuit-pattern formation, biological tissue preparation, or three-dimensional shaping.

INDUSTRIAL UTILITY

As noted above, this invention is suitable to an inkjet printing apparatus.

DESCRIPTION OF REFERENCES

1 controller
2 transporting section
3 ejector
4 drying section
5 inspecting section
9 sheet
30, 30*k*, 30*c*, 30*m*, 30*y* inkjet nozzle group
31 cleaning section
311, 311*a*, 311*b*, 311*c*, 311*d*, 311*e*, 311*f*, 311*g*, 311*h* suction cap
312, 312*a*, 312*b*, 312*c*, 312*d*, 312*e*, 312*f*, 312*g*, 312*h*, 312*z* suction tube
313 electromagnetic on/off valve
314 suction pump
315 connection switching section
316 suction line
315*h*, 315'*h* 3150*h* housing
315*i*, 315*ia*, 315*ib*, 315*ic*, 315*id*, 315*ie*, 315*if*, 315*ig*, 315*ih*,
315*iz*, 3150*i* suction port
315*k*, 315'*k*, 3150*k* switching section
315*j* closed bearing
315*o*, 315'*o*, 3150*o* ink draw-off port

The invention claimed is:

1. An inkjet printing apparatus with a plurality of inkjet heads having a plurality of inkjet nozzles being arranged in a row; a plurality of caps for the plurality of inkjet heads respectively; a plurality of lines in communication with the plurality of caps respectively; and a suction device sucking ink from the plurality of inkjet nozzles via the plurality of caps and the plurality of lines, the inkjet printing apparatus comprising:

a housing having a plurality of external suction ports, an internal suction port and an ink-draw-off port, the plurality of external suction ports being connected to the plurality of caps via the plurality of lines;

a switching section disposed in the housing and having an internal communication path in communication with the suction device;

a connection switching device for selectively connecting the switching section to any port of the plurality of external suction ports or the internal suction port by moving the switching section to a position where the communication path is brought into communication with any port of the plurality of external suction ports or the internal suction port; and a suction path disposed out of the housing for connecting the internal suction port to the ink-draw-off port for sucking an interior of the housing, wherein the ink in the housing is discharged from the ink draw off port to a suction line through the suction path and the internal suction port.

2. The inkjet printing apparatus according to claim 1, wherein the housing comprises the draw-off port of the suction path on the bottom of the housing, the suction path sucking the interior of the housing.

3. The inkjet printing apparatus according to claim 1, wherein the housing comprises the suction path sucking the interior of the housing.

4. The inkjet printing apparatus according to claim 3, wherein the plurality of inkjet heads is provided for every single-color ink.

5. The inkjet printing apparatus of claim 1, wherein the housing comprises the plurality of external suction ports arranged radially.

6. The inkjet printing apparatus of claim 5, wherein the switching section has an L-shape, and wherein a first end of the switching section is configured to rotate, whereas a second end thereof is configured to communicate with each of the plurality of external suction ports.

7. The inkjet printing apparatus according to claim 6, wherein the housing comprises a closed bearing at the center of rotation of the switching section.

8. The inkjet printing apparatus of claim 1, wherein the housing comprises the plurality of external suction ports arranged coaxially.

9. The inkjet printing apparatus according to claim 8, wherein the switching section has a crank shape, and a first end of the switching section is configured to rotate, whereas a second end thereof is configured to communicate with each of the plurality of external suction ports.

10. The inkjet printing apparatus according to claim 9, wherein the housing comprises a closed bearing at the center of rotation of the switching section.

* * * * *